United States Patent [19]

Cohen et al.

[11] 4,092,188

[45] May 30, 1978

[54] NITRAMINE PROPELLANTS

[76] Inventors: Alan M. Lovelace, Acting Administrator of the National Aeronautics and Space Administration, with respect to an invention of Norman S. Cohen, Redlands and Leon D. Strand, both of Pasadena, Calif.

[21] Appl. No.: 797,210

[22] Filed: May 16, 1977

[51] Int. Cl.[2] ..... C06B 45/10

[52] U.S. Cl. ..... 149/19.4; 149/19.8; 149/88; 149/92; 149/93; 149/105; 149/111

[58] Field of Search ..... 149/92, 19.4, 19.8, 149/93, 105, 88, 111

[56] References Cited

U.S. PATENT DOCUMENTS

| | | | |
|---|---|---|---|
| 3,798,090 | 3/1974 | Allabashi | 149/19.4 |
| 4,011,114 | 3/1977 | Allabashi | 149/19.4 |

*Primary Examiner*—Stephen J. Lechert, Jr.
*Attorney, Agent, or Firm*—Monte F. Mott; Wilfred Grifka; John R. Manning

[57] ABSTRACT

Nitramine propellants absent a pressure exponent shift in the burning rate curves are prepared by matching the burning rate of a selected nitramine or combination of nitramines within 10% of burning rate of a plasticized active binder so as to smooth out the break point appearance in the burning rate curve.

14 Claims, 5 Drawing Figures

NITRAMINE PROPELLANTS

ORIGIN OF THE INVENTION

The invention described herein was made in the performance of work under a NASA contract and is subject to the provisions of Section 305 of the National Aeronautics and Space Act of 1958, Public Law 83-568 (72 Stat. 435; 42 USC 2457).

BACKGROUND OF THE INVENTION

1. Field of the Invention

The present invention relates to improved nitramine-containing propellant fomrulations, and more particularly to a formulation which does not exhibit sharp exponent shift in the burning rate curve.

2. Description of the Prior Art

Nitramines are of interest for gun and rocket propellant applications because they are an energetic source of smokeless combustion products. There has been increasing activity involving propellant formulations containing nitramine compounds for use in guns. One reason for this is the need for increased muzzle velocity within acceptable pressure limits while retaining good barrel life. Nitramine containing formulations are also of interest in efforts directed toward developing lower vulnerability propellants.

However, considerable difficulty has been encountered in obtaining the ballistic performance expected on the basis of thermochemical properties. The newer nitramine propellants exhibit combustion anomalies which are referred to as pressure sensitivity factors. The problem has many aspects, but is best summarized in terms of burning rate curves, where nitramine propellants exhibit sharp "exponent break points" or exponent shifts in the logarithmic burning rate curves. This lack of a smooth burning and break point appearance with rapid burning has long been a problem in the formulation of nitramine propellants of all types. It has been observed that many of the formulations have burning rate vs pressure characteristics which are substantially different from those of the conventional nitrate ester gun propellants. Many of the compositions have pressure exponents $<1$ below 4000 psi and $>1$ above 4000 psi. The difficulties encountered in obtaining the desired ballistic performance with these propellants are usually attributed to the above-described pressure vs burning rate behavior.

SUMMARY OF THE INVENTION

The mechanism for the above-mentioned anomalous burning rate behavior has now been determined by the inventors herein. At low pressure, the binder exerts a significant role in the burning process because the admixture of binder and explosive powder melts on the propellant surface. At high pressure, the burning takes on the character of the powder itself because the heating rates become too high for melt layer formation and a cratered surface influenced by the powder appears. The high pressure exponent thus manifests a transition between these two processes. The reason that the high pressure exponent appears is that the burning rate of the powder exceeds the burning rate of the binder in the gun propellants referred to. An analytical model of this process shows a dependence on the particle size and melting point of the powder.

Specifically, a finer particle size and a lower melting point allows the melt layer to continue forming to higher heating rates and pressures. Thus the transition can be avoided by using sufficiently fine powder for a given material. For propellants referred to, the particle size of nitramines such as HMX should not exceed 4 microns, or 8 microns for lower melting point ingredients such as TAGN (triaminoguanidine nitrate), in order to avoid the exponent shift to a pressure of 50,000 psi. Although mean sizes of four microns are within state-of-the-art, it may not be practical to manufacture propellants containing a maximum size of four microns at current state-of-the-art.

Another manner that is proposed to smooth the break is to utilize a mixture with nitramines, such as TAGN with HMX or RDX. At low pressure the TAGN addition raises burning rate because of its faster decomposition and flame kinetics and its higher net exothermicity of decomposition. This higher burning rate will cause the HMX or RDX to exhibit its own break point at lower pressure. However, the shift or jump distance is not as great as with HMX alone because the TAGN component still produces a planar melt component to the surface structure. Eventually, the TAGN itself produces a second break point at high pressure, but the line is not as high as with TAGN alone because the HMX component kinetics are slower. This second break can be deferred to very high pressure if sufficiently fine TAGN is used; thus only the first break appears, is not extensive, can appear to be absent in fitting the data. TAGN exhibits its break point at higher pressures (burning rates) than HMX because its melting point is lower. Thus the planar melt surface is retained over a broader range of conditions.

However, the mixing of TAGN and HMX to achieve an effective pinching of the lines involves a tradeoff. Too much TAGN will raise burning rates excessively so as to foster its own break and the optimum ratio is dependent upon the particle sizes used and the maximum pressure of interest.

Break point appearance in energetic nitramine containing formulations are avoided in accordance with the invention by selection of a plasticized binder having a monopropellant burning rate at selected pressure within $\pm 10\%$ of the monopropellant burning rate of the nitramine. When this is achieved, the transition cannot manifest itself as a shift because the binder-influenced rate becomes equal to the powder-controlled rate. Furthermore, since the burning rates match, the nitramine can be present in any percentage and in any particle size.

These and many other features and attendant advantages of the invention will become apparent as the invention becomes better understood by reference to the following detailed description when considered in conjunction with the accompanying drawings.

DESCRIPTION OF THE PREFERRED EMBODIMENTS

Figure 1:
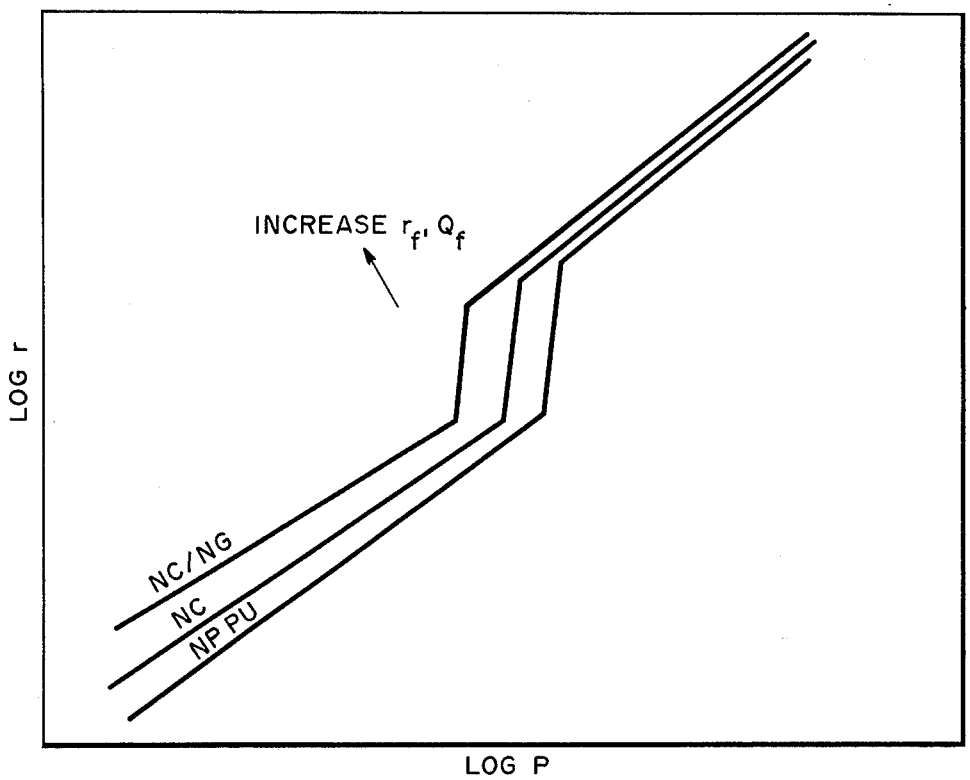
FIG. 1 is a series of burning rate curves for various active binders with LOG P (pressure) as abscissa and LOG r (burning rate) as ordinate.

The compositions of the invention comprise a binder component and a nitramine. The nitramine is usually present in an amount from 30% to 85% by weight depending upon the propellant characteristics desired. Typical nitramines are cyclotetramethylenetetranitramine (HMX), cyclotrimethylenetrinitramine (RDX) and ethylene dinitramine (EDNA). Typical related powders are nitroguanidine (NQ) and triaminoguanidine nitrate (TAGN).

The nitramine powders can be fine grained, coarse grained or multimodal in size ranging up to 250 microns. The burning rates of RDX and HMX are approximately 3.5 in/sec at 10,000 psi and the burning rate of EDNA is approximately 2.2 in/sec at 10,000 psi.

A binder having a matched monopropellant rate can be selected from active single-base binders, double-base binders or inert binders plasticized with energetic plasticizers. Representative inert binder polymers are polyurethanes such as ethyl cellulose based polyurethanes, polyester based polyurethanes such as neopentylglycol azelate (NPGA), polyether based polyurethanes such as polyoxypropylene diol (PPG) and butadiene based polyurethanes such as hydroxyl-terminated polybutadienes (HTPB).

Energetic plasticizers can be compounded with the inert binders in amounts up to 50% to 60% by weight. Representative energetic plasticizers are organic nitrates such as triethylene glycol dinitrate (TEGDN), trimethylol ethane trinitrate (TMETN), nitroglycerine (NG), pentaerythritol trinitrate, diethylene glycol dinitrate and the like.

Slurry cast, nitramine filled nitrocellulose plastisols offer flexibility and low cost. The nitrocellulose usually contains from 12.2% to 13.5% nitrogen and can be compounded with 10% to 40% by weight of nitrate ester energetic plasticizers (double-based) and/or inert or desensitizing plasticizers (single-base) to provide the desired monopropellant burning rate characteristics. The nitrocellulose binder usually contains from 0.5% to 2.0% by weight of a stabilizer such as sym-diethyldiphenylurea, 2-dinitrophenylamine and other phenyl compounds capable of scavenging $NO_2$ radicals. Slurry casting procedures are disclosed in U.S. Pat. No. 2,967,098, the disclosure of which is expressly incorporated herein by reference.

Single-base and double-base nitrocellulose binders having a wide range of burning rates are available within the current state-of-the-art. It is well known that the burning rate of the binder correlates with the energy or heat of explosion. Lower burning rates are achieved through use of low-energy or inert plasticizers such as butadiene or urethane pre-polymers, dinitrotoluene, dibutylphthalate, diocylazelate or triacetin. Increasing the content of these plasticizers lowers the burning rate. Examples are M-1 and M-6 propellants, which have a burning rate of approximately 1 in/sec at 10,000 psi. Higher burning rates are achievable with higher energy plasticizers, such as triethylene glycol dinitrate (TEGDN), trimethylol ethane trinitrate (TMETN) and nitroglycerine. Increasing the concentration of nitroglycerine increases burning rate. Examples are M-2, M-5, M-8, M-13 and JPN propellants. The burning rates at 10,000 psi are in the range of 3–5 in/sec. Combinations of these approaches yield intermediate burning rates. Examples are M-10, M-15, EC-NACO, H-9, MRP and OV propellants.

FIG. 1 shows the effect of active binder type which, parametrically, is an effect of the inherent burning rate and energy release of the binder itself ($r_b$, $Q_b$). It is well-known that, for active binders, burning rate and energy are correlative. An increase in these parameters tends to increase burning rates at low (pre-break) pressures more so than at high (post-break) pressures, such that a pinching of the lines results. The nitramine appears to dominate the high pressure result as in the case of inert binder propellants. At low pressure, the burning rates of the active binder propellants tend to be higher than those of the inert binder propellants such that the slope break appears less severe.

HMX, RDX and TAGN are representative of powders whose burning rates are higher than the rates of the active binders in which they are incorporated. The question arises as to the result if the powder burning rate were equal to or less than the binder burning rate. It is predicted that if these rates are equal, and there is not powder-binder combustion interaction (e.e., no diffusion flame), there should be no burning rate jump. The absence of a diffusion flame may be rationalized by the stoichiometries of each monopropellant; thus there is interaction between ammonium perchlorate and active binder but not between HMX and active binder. If the powder rate is less than the binder rate, the break will appear as a mesa. In actual practice, the mesa would appear as a plateau or low slope region as the burning rate moves from a position close to the binder line toward a position close to the powder monopropellant line.

Figure 2:
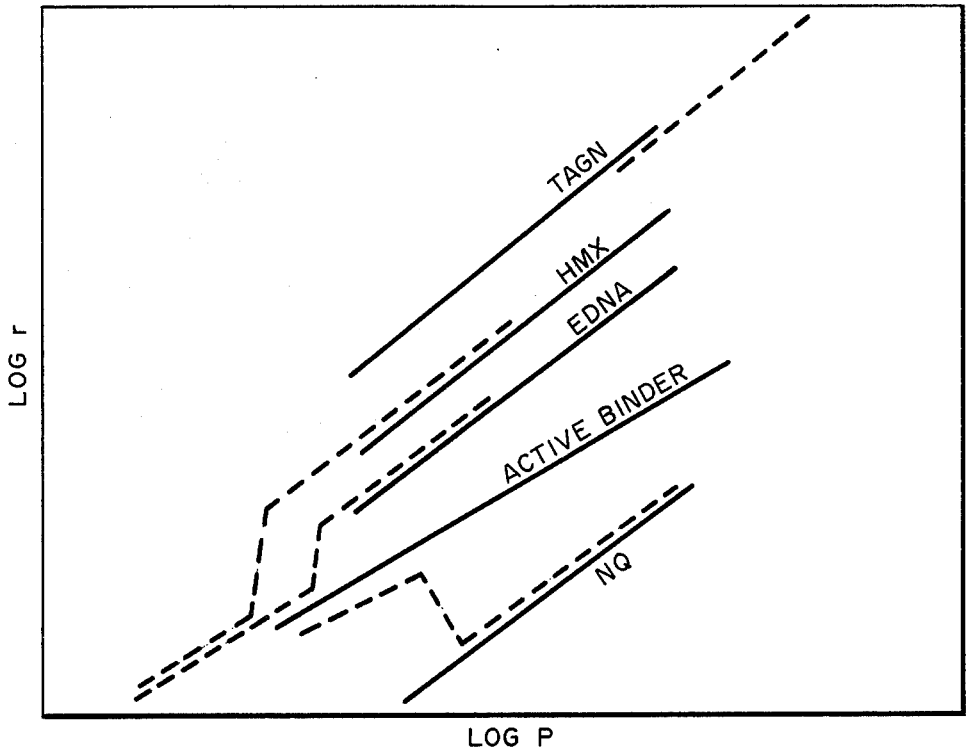
FIG. 2 is a series of burning rate curves for monopropellants with LOG P as abscissa and LOG r (burning rate) as ordinate.

These effects are illustrated in FIG. 2. The solid lines represent monopropellant data. The dashed lines represent model calculations for propellants which, with the exception of NQ, are confirmed by data. Note that, in the case of TAGN, HMX and EDNA, the post-break burning rates closely follow the respective monopropellant powder burning rate line. Note also that the lower the powder rate, the closer it is to the binder monopropellant line, the less the burning rate jump above the binder line for the propellant. It is speculated that a closer matching of the rates would further diminish the extent of the jump, and in the limit would approach zero. The idealized mesa for NQ is also illustrated. This reflects the idealized result for a single particle size. For actual particle size distributions, this result would appear as a low slope region aiming for the NQ line; an upward shift in exponent would then occur when this low slope line meets the NQ line at high pressure. The fact that triple-base propellants containing high concentrations of NQ do exhibit low slopes is well-known.

Figure 3:
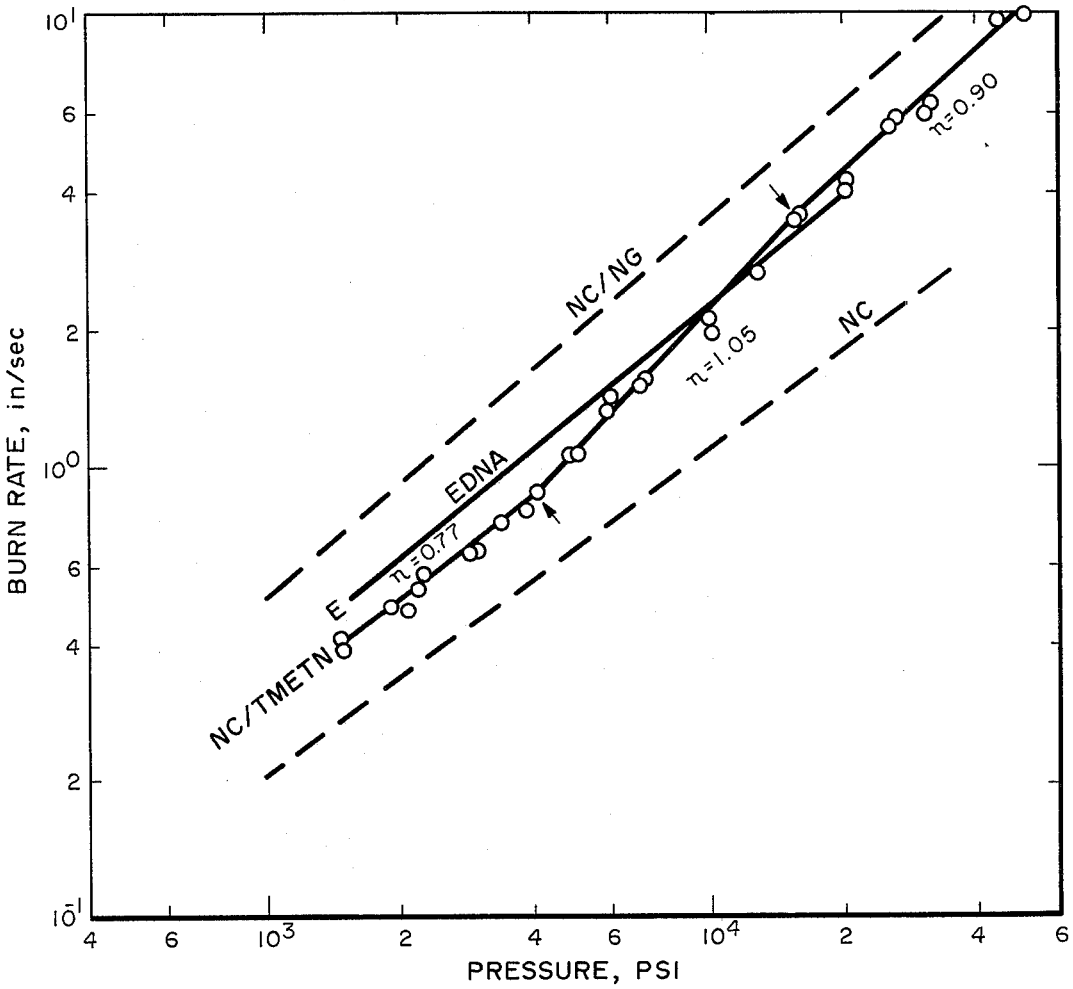
FIG. 3 is a series of curves illustrating the effect of plasticizer on burning rate of nitramine-nitrocellulose binders.

An illustration of binder tailorability to implement the foregoing approach is presented in FIG. 3. The lower dashed line is for nitrocellulose (NC) containing an inert plasticizer. The upper dashed line is for nitrocellulose containing a very energetic plasticizer. The solid line is for nitrocellulose containing TMETN, an intermediate energetic plasticizer. The range of burning rates is observed to cover a factor of 3. A larger range would be available by adjusting ingredient proportions, subject to energy and processing limitations; a practical range of 5 is indicated by existing active binders. The intermediate binder shown in FIG. 3 has burning rates quite close to EDNA burning rates, as shown and provides a matched binder-nitramine formulations absent a break.

Figure 4:
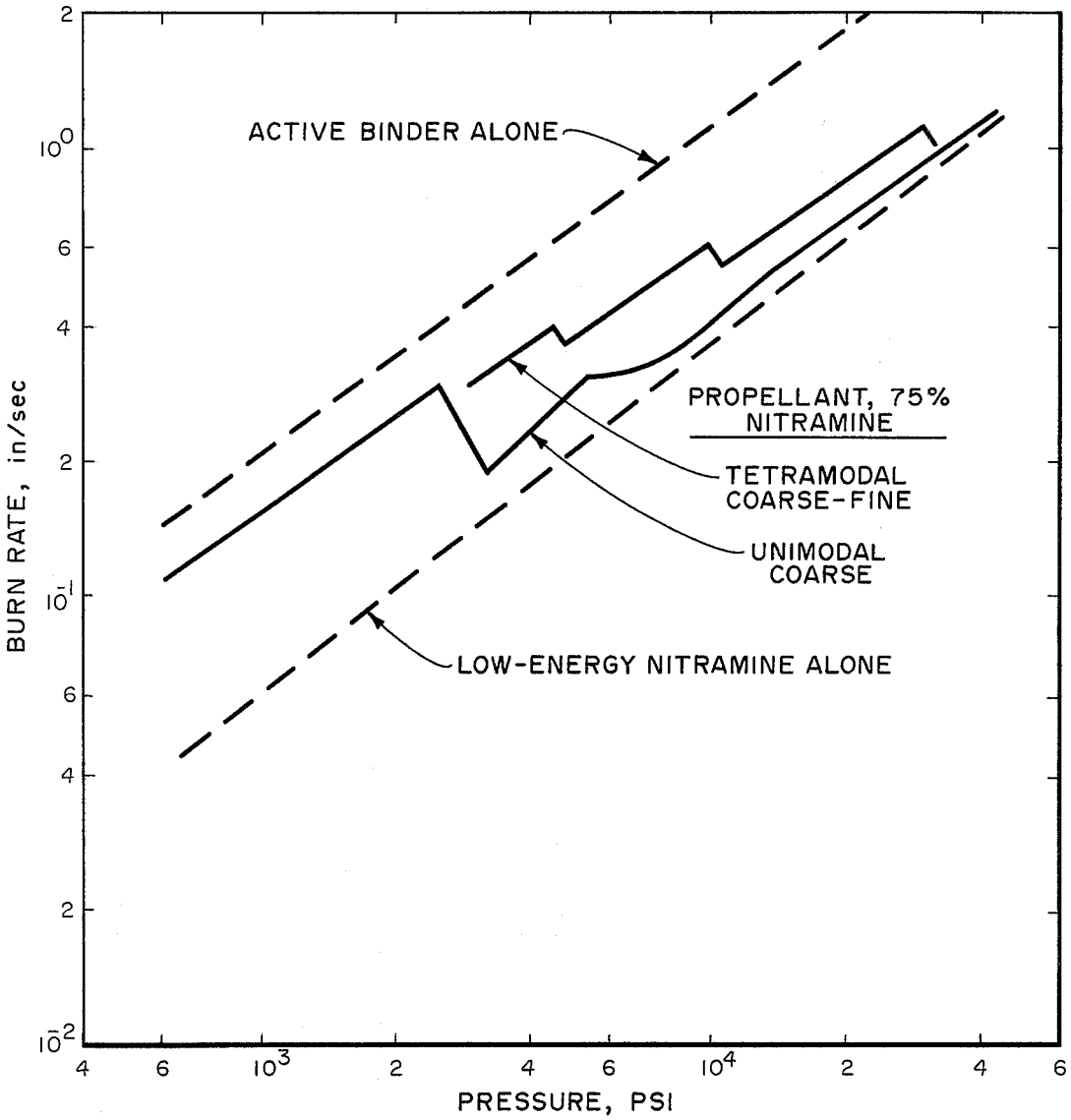
FIG. 4 is a series of curves illustrating reverse break points caused by low burning rate nitramine.

A low energy nitramine whose burning rate is less than the binder rate may be represented by nitroguanidine (NQ). As shown in FIG. 4, for a unimodal propellant, the transition indeed causes a downward shift in burning rate. The binder is more influential at the lower pressures, and the nitramine becomes most influential at the higher pressures. This downward break can be stretched out by assuming a tetramodal propellant. In the limit, with a continuous size distribution, the result is a range of pressures over which there would be a continuous low exponent.

Figure 5:
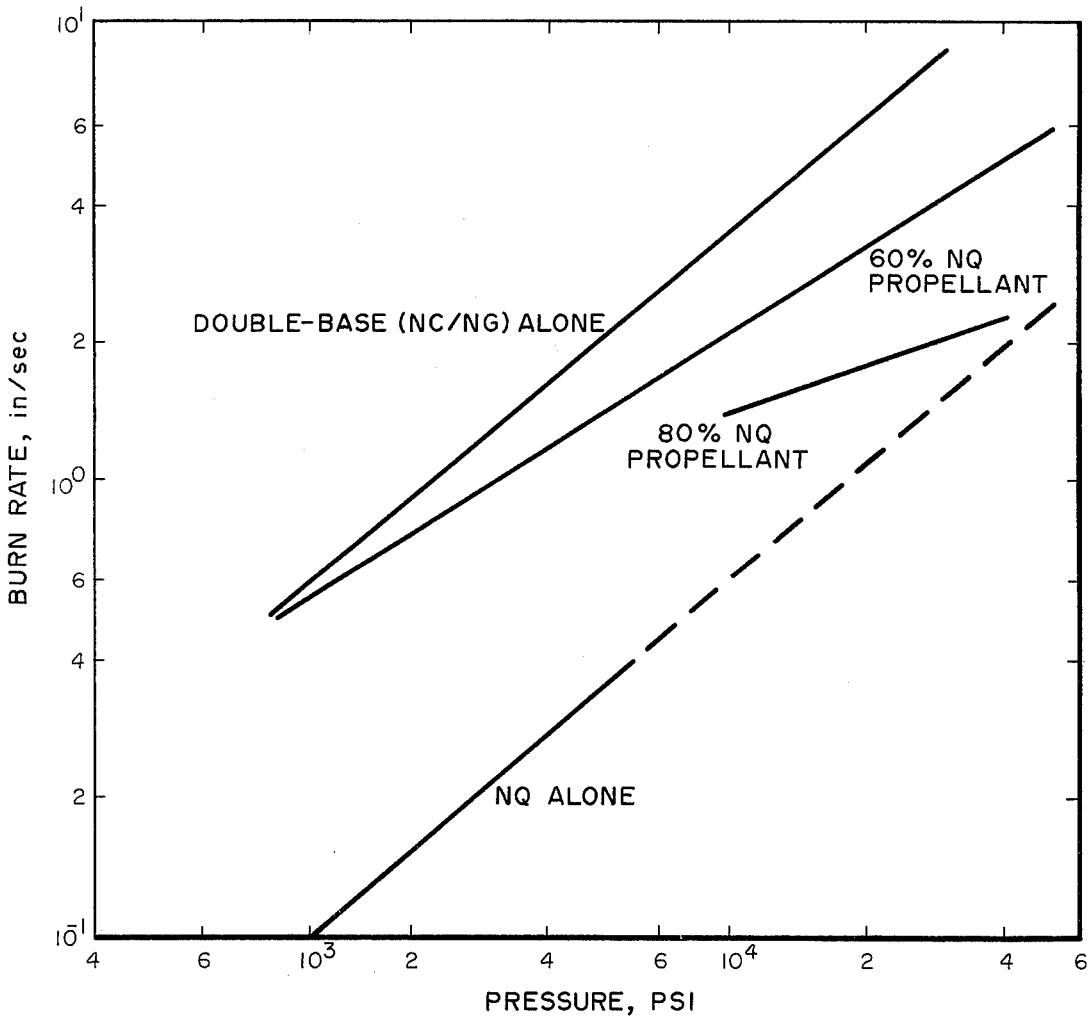
FIG. 5 is a series of burn rate curves of high solids loading triple-base propellants.

Evidence supporting this is available from NC/NG triple base propellants incorporating high concentrations of NQ into energetic active binders. Representative data are shown in FIG. 5. Essentially, the propellant burning rate starts out closed to the binder rate and thereafter aims for the NQ rate. This is more pronounced with higher NQ loading. Note that there may be cause for a break point when the propellant line meets the NQ line; however, the pressure is probably high enough to tolerate it in practice.

The approach of combining low energy, low rate nitramines with high energy or matched active binders is attractive for two reasons. First, the propellant flame temperature need not be high. Second, active binders can be tailored in conjunction with nitramine selection to afford flexibility in the matching as long as there is no nitramine-binder chemical interaction.

Further examples of matched burning rate propellant formulations follow:

EXAMPLE 1

| Material | Binder Amount, Wt % |
|---|---|
| Nitrocellulose | 52 |
| Nitroglycerine | 43 |
| Inert Polyester Plasticizer | 4.4 |
| Stabilizer | 0.6 |

This binder has a burning rate matching that of RDX or HMX which can be combined in any proportion and any particle size. For a suitable energetic propellant, HMX having an average particle size of 20 microns should be combined in an amount of 10% to 30% by weight of the formulations.

EXAMPLE 2

| Material | Binder Amount, Wt % |
|---|---|
| Nitrocellulose | 82 |
| Nitroglycerine | 15 |
| Inert Polyester Plasticizer | 2.4 |
| Stabilizer | 0.6 |

This binder has a burning rate matching that of EDNA. Again particle size and amount of nitramine are immaterial as far as an exponential shift is concerned. For a suitable gun propellant, EDNA having an average particle size of 20 microns is present in the formulations in an amount of 50% to 75% by weight.

It is to be realized that only preferred embodiments of the invention have been described and that numerous substitutions, modifications and alterations are permissible without departing from the spirit and scope of the invention as defined in the following claims.

What is claimed is:

1. A gun propellant composition absent an exponent shift in the burning rate curve consisting essentially of a dispersion of
   energetic nitramine particles in
   a plasticized binder having a monopropellant burning rate at selected pressure within ±10% of the monopropellant burning rate of the nitramine.

2. A composition according to claim 1 in which the nitramine is present in an amount from 30% to 85% by weight.

3. A composition according to claim 2 in which the nitramines are selected from cyclotetramethylenetetranitramine, cyclotrimethylenetrinitramine, ethylene dinitramine, nitroguanidine or triaminoguanidine nitrate.

4. A composition according to claim 3 in which the binder is selected from active single-base binders, double-base binders or inert binders plasticized with energetic plasticizers.

5. A composition according to claim 4 in which the inert binder is a polyurethane and the energetic plasticizer is an organic nitrate present in the binder in an amount from 50% to 60% by weight.

6. A composition according to claim 5 in which the energetic organic nitrate plasticizer is selected from triethylene glycol dinitrate, trimethylol ethane trinitrate, nitroglycerine, pentaerythritol trinitrate or diethylene glycol dinitrate.

7. A composition according to claim 4 in which the single-base and double-base binders include nitrocellulose and 10% to 40% by weight of plasticizer.

8. A composition according to claim 7 in which the single-base nitrocellulose binder includes a low energy or inert plasticizer selected from a butadiene prepolymer or urethane prepolymer, dinitrotoluene, dibutylphthalate, dioctylazelate or triacetin.

9. A composition according to claim 7 in which the double-base nitrocellulose binder includes an energetic plasticizer selected from triethylene glycol dinitrate, trimethylol ethane trinitrate and nitroglycerine.

10. A composition according to claim 9 in which the binder includes nitrocellulose plasticized with trimethylol ethane trinitrate and the nitramine is ethylene dinitramine.

11. A composition according to claim 10 in which the nitramine is selected from cyclotetramethylenetetranitramine or cyclotrimethylenetrinitramine and the binder comprises nitrocellulose and a plasticizer including nitroglycerine and a minor amount of inert polyester plasticizer.

12. A composition according to claim 10 in which the nitramine is ethylene dinitramine and the binder comprises nitrocellulose and a plasticizer including nitrocellulose and a minor amount of an inert polyester plasticizer.

13. A composition according to claim 2 in which the particle size of the nitramine is less than 250 microns.

14. A composition according to claim 12 in which the particle size of the nitramine is less than 8 microns.

* * * * *